US009217445B2

(12) United States Patent
Lo

(10) Patent No.: US 9,217,445 B2
(45) Date of Patent: Dec. 22, 2015

(54) FAN

(71) Applicant: Yi-Sheng Lo, Kaohsiung (TW)

(72) Inventor: Yi-Sheng Lo, Kaohsiung (TW)

( * ) Notice: Subject to any disclaimer, the term of this patent is extended or adjusted under 35 U.S.C. 154(b) by 445 days.

(21) Appl. No.: 13/736,335

(22) Filed: Jan. 8, 2013

(65) Prior Publication Data

US 2013/0243588 A1 Sep. 19, 2013

(30) Foreign Application Priority Data

Mar. 13, 2012 (TW) ..... 101108481 A

(51) Int. Cl.
*F04D 29/54* (2006.01)
*F04D 25/08* (2006.01)
*F04F 1/00* (2006.01)

(52) U.S. Cl.
CPC ..... *F04D 29/547* (2013.01); *F04D 25/08* (2013.01); *F04F 1/00* (2013.01)

(58) Field of Classification Search
None
See application file for complete search history.

(56) References Cited

FOREIGN PATENT DOCUMENTS

CN 102251994 A * 11/2011

OTHER PUBLICATIONS

CN 102251994 A Machine Translation. Accessed EPO website May 20, 2015.*

* cited by examiner

*Primary Examiner* — Richard Edgar
(74) *Attorney, Agent, or Firm* — Occhiuti & Rohlicek LLP

(57) ABSTRACT

A bladeless fan includes a wind supply device and a first wind guide device disposed on the wind supply device and having a loop-shaped space. Airflow is created by the wind supply device, and enters the loop-shaped space. When the airflow exits the loop-shaped space through an air outlet, surrounding air is forced to flow through a flow guide channel in the first wind guide device to combine with the air flowing from the air outlet, so as to increase the amount and speed of the airflow.

9 Claims, 6 Drawing Sheets

FAN

CROSS-REFERENCE TO RELATED APPLICATION

This application claims priority of Taiwanese Application No. 101108481, filed on Mar. 13, 2012.

BACKGROUND OF THE INVENTION

1. Field of the Invention

This invention relates to a fan, and more particularly to a bladeless fan.

2. Description of the Related Art

Bladeless fans have been used for safety purposes. Typically, a conventional bladeless fan has a loop-shaped air outlet of a relatively small width, and thus cannot provide sufficient amount and speed of airflow.

SUMMARY OF THE INVENTION

Therefore, the object of this invention is to provide a fan that can increase the amount and speed of the airflow created thereby.

According to this invention, there is provided a fan comprising:

a wind supply device including a hollow base, a blade disposed within the base, and a motor disposed within the base for rotating the blade to create an airflow, the base having a wind supply opening permitting the airflow to exit the base therethrough; and a first wind guide device disposed on the base of the wind supply device and including a first outer loop-shaped wall that is disposed around a first axis and that has opposite front and rear peripheries, a first inner loop-shaped wall surrounded by the first outer loop-shaped wall and secured to and extending from the front periphery of the first outer loop-shaped wall toward the rear periphery of the first outer loop-shaped wall, and a first wind guide wall secured to and extending from the rear periphery of the first outer loop-shaped wall toward the first inner loop-shaped wall, the first inner loop-shaped wall having a distal end portion adjacent to the rear periphery of the first outer loop-shaped wall and extending away from the first axis, the first outer loop-shaped wall further having a distal end portion extending from the rear periphery of the first outer loop-shaped wall and between the distal end portion of the first inner loop-shaped wall and the first wind guide wall, the first outer and inner loop-shaped walls cooperating to define a first loop-shaped space in fluid communication with the wind supply opening and permitting the airflow to enter thereinto, the first loop-shaped space having a first air outlet disposed between the distal end portions of the first outer and inner loop-shaped walls and permitting exit of the airflow therefrom, the first wind guide wall cooperating with the distal end portion of the first outer loop-shaped wall to define a first flow guide channel, the first wind guide wall having a front end disposed in front of the distal end portion of the first outer loop-shaped wall, and a plurality of first air inlets that are angularly spaced apart from each other, that are adjacent to the rear periphery of the first outer loop-shaped wall, and that are in fluid communication with the first flow guide channel, the first flow guide channel having a first wind increasing opening that is disposed at an end thereof distal from the first air inlets and that is in fluid communication with the first air outlet so that, when the airflow occurs in the first loop-shaped space, surrounding air is forced to enter the first flow guide channel through the first air inlets and exit the first flow guide channel through the first wind increasing opening to combine with the air flowing from the first air outlet.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
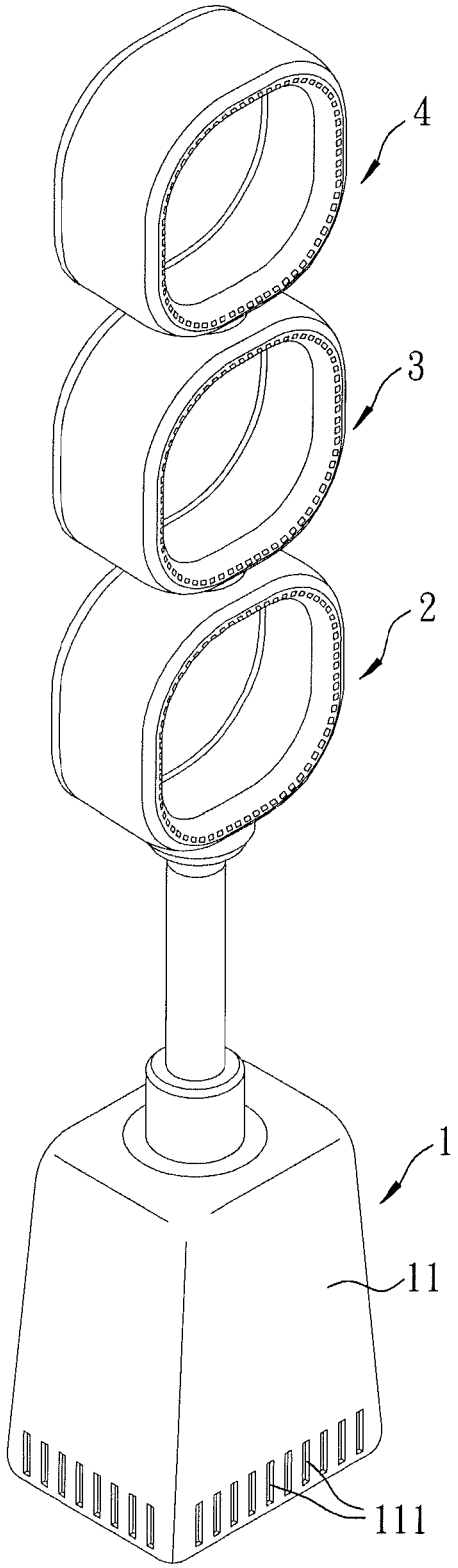
FIG. 1 is a perspective view of the preferred embodiment of a fan according to the invention.
Figure 2:
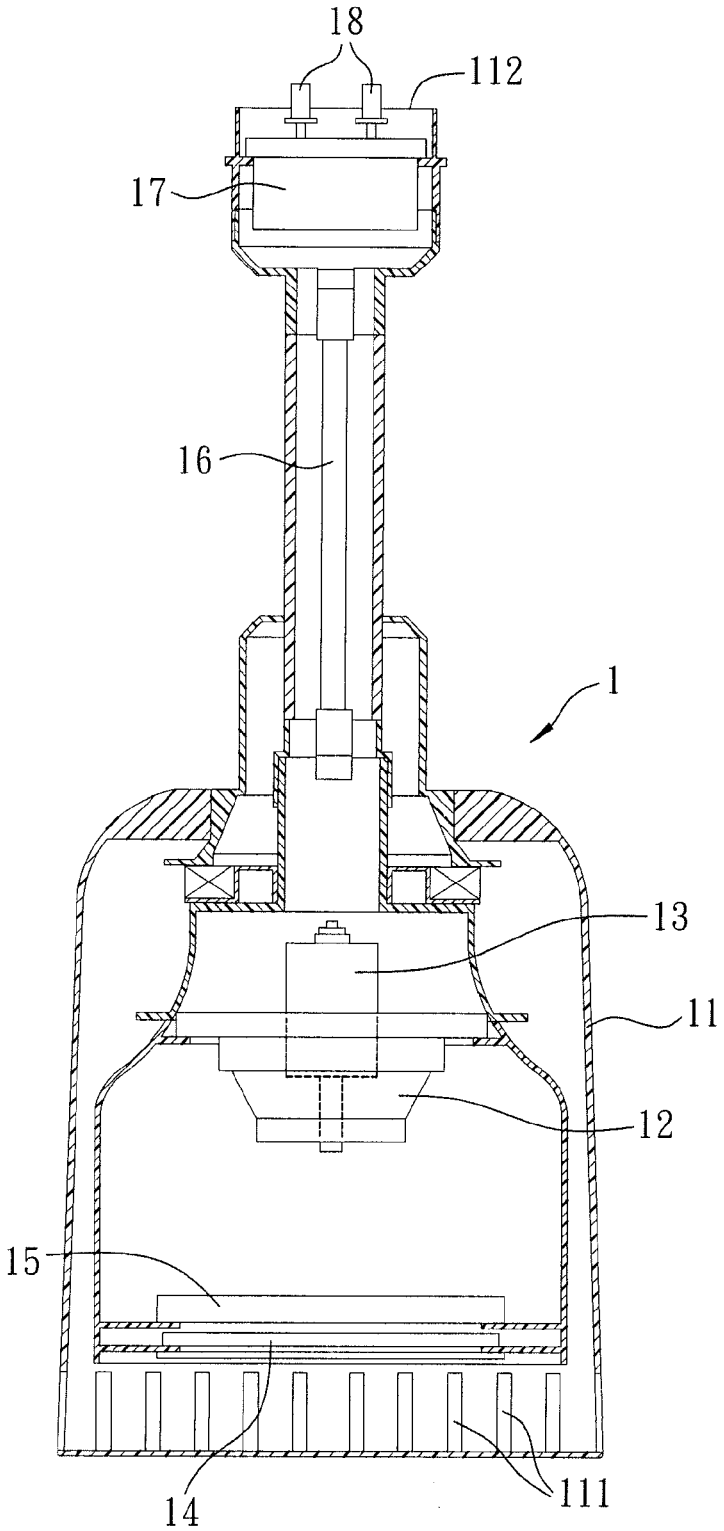
FIG. 2 is a fragmentary sectional view of the preferred embodiment.

Referring to FIGS. 1 and 2, the preferred embodiment of a fan according to this invention includes a wind supply device 1, a first wind guide device 2, a second wind guide device 3, and a third wind guide device 4.

The wind supply device 1 is used for creating an airflow, and includes a hollow base 11, a blade 12 disposed within the base 11, and a motor 13 disposed within the base 11 and operable for rotating the blade 12. The base 11 has a plurality of intake air ports 111 disposed at a bottom portion thereof and permitting entry of air, and a wind supply opening 112 disposed at at top portion thereof and permitting exit of the air. During use, when the motor 13 is operated to drive rotation of the blade 12, surrounding air enters the intake airports 111, and subsequently flows upwardly out through the wind supply opening 112.

The wind supply device 1 further includes a filtering cotton 14, a filtering net 15 made of active carbon, a UV lamp 16, a heater 17 disposed above the UV lamp 16 for heating the airflow, and a carbon brush unit 18 for generating negative ions. As such, before the airflow exits the wind supply device 1, dust can be filtered, germs can be killed, and odor and harmful substances can be eliminated. Consequently, purified air can be supplied by the wind supply device 1. If necessary, the purified air may be heated by the heater 17 to form hot wind.

In this embodiment, the first wind guide device 2 is disposed rotatably on and above the base 11 of the wind supply device 1, the second wind guide device 3 is disposed rotatably on and above the first wind guide device 2, and the third wind guide device 4 is disposed on and above the second wind guide device 3. The purified air is split to exit from the first, second, and third wind guide devices 2, 3, 4.

Figure 3:
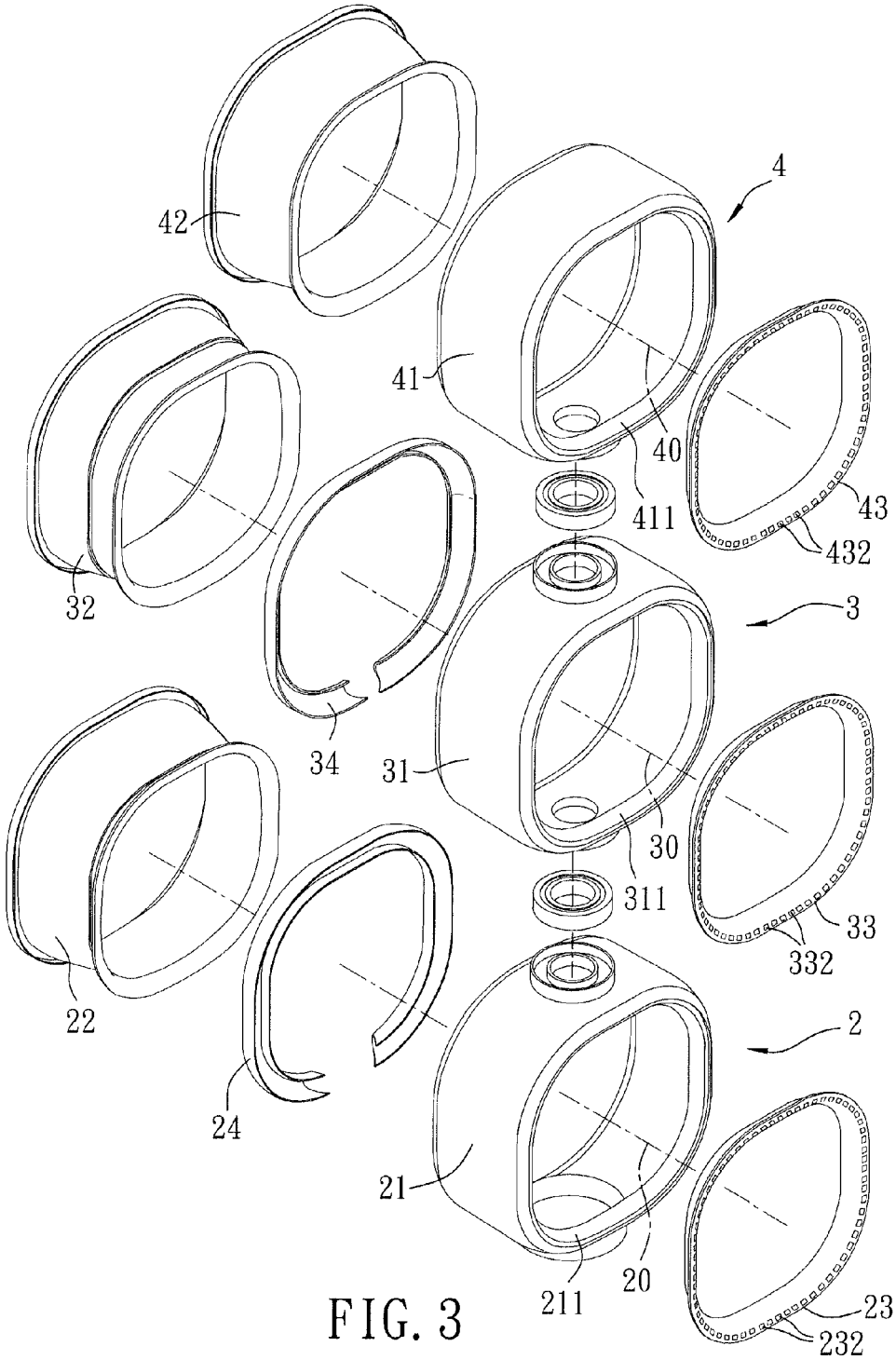
FIG. 3 is a fragmentary, exploded perspective view of the preferred embodiment, illustrating a first wind guide device, a second wind guide device, and a third wind guide device.
Figure 4:
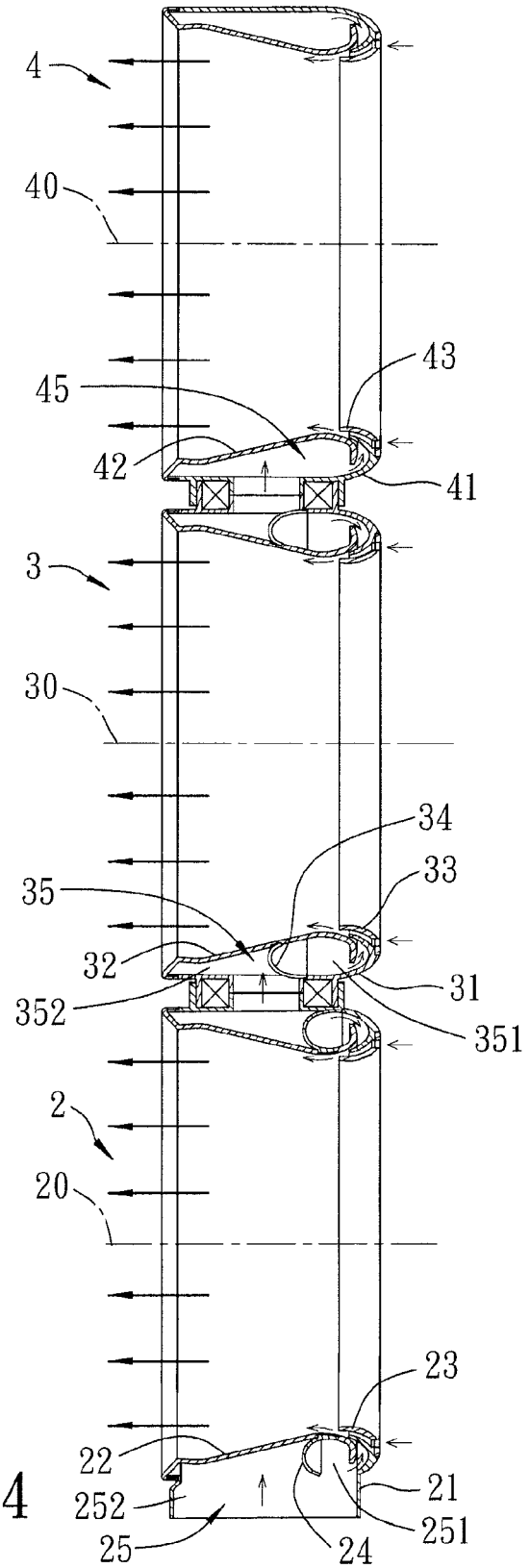
FIG. 4 is a fragmentary, partly sectional view of the preferred embodiment, illustrating the first, second, and third wind guide devices.
Figure 5:
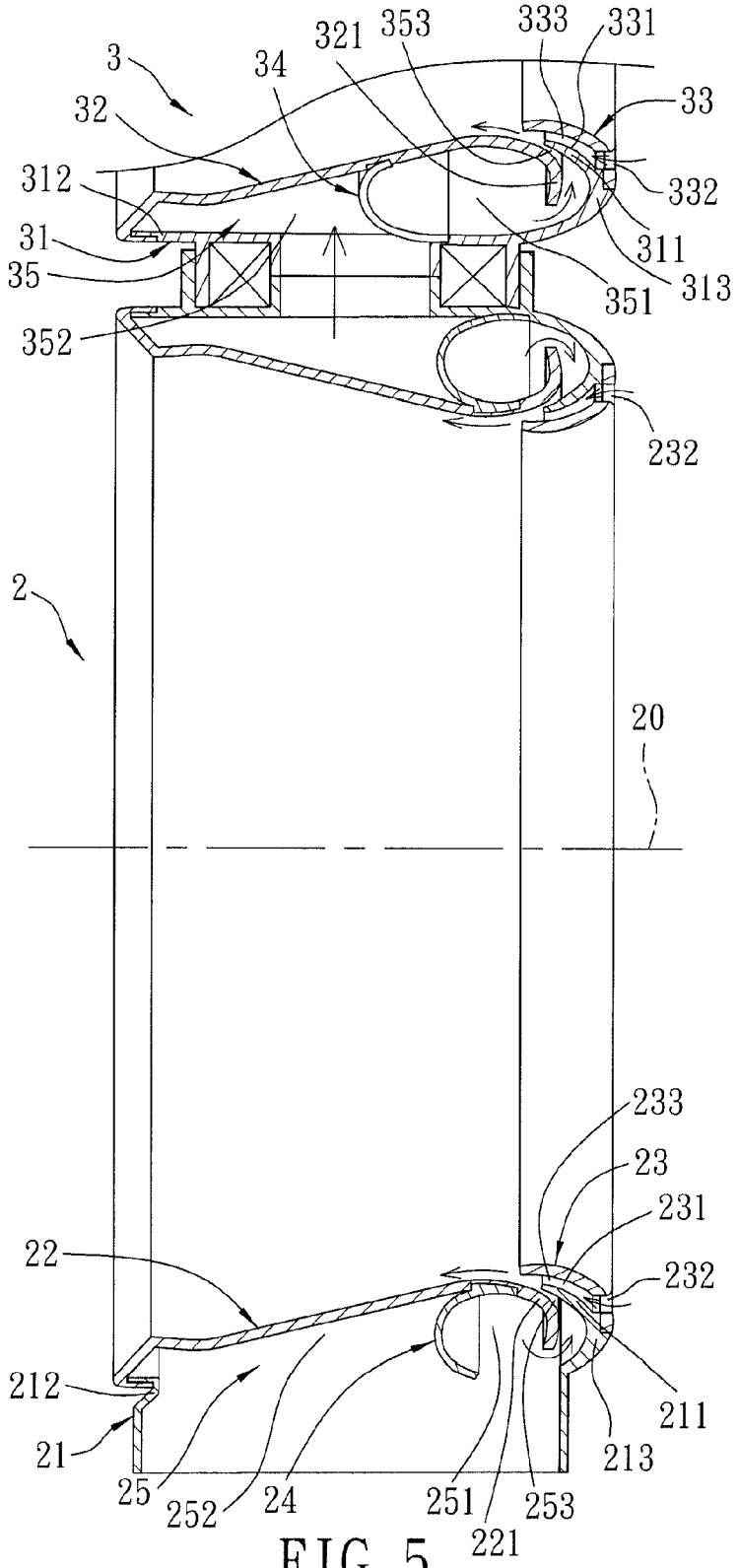
FIG. 5 is an enlarged view of one portion of FIG. 4, illustrating the first and second wind guide devices.

With further reference to FIGS. 3, 4, and 5, the first wind guide device 2 is loop-shaped, and includes a first outer loop-shaped wall 21 disposed around a first axis 20, having front and rear peripheries 212, 213 opposite to each other along the first axis 20, a first inner loop-shaped wall 22 surrounded by the first outer loop-shaped wall 21 and secured (e.g., welded) to and extending inclinedly from the front periphery 212 toward the rear periphery 213, a first wind guide wall 23 surrounded by the first outer loop-shaped wall 21 and secured (e.g., welded) to and extending from the rear periphery 213 toward the first inner loop-shaped wall 22, and a first flow-splitting wall 24 secured (e.g., welded) to and extending from the first inner loop-shaped wall 22 in a direction away from the first axis 20 and connected between the first outer and inner loop-shaped walls 21, 22.

The first inner loop-shaped wall 22 has a distal end portion 221 adjacent to the rear periphery 213 and extending away from the first axis 20. The first outer loop-shaped wall 21 has a distal end portion 211 extending from the rear periphery 213 toward the first axis 20 and between the distal end 221 of the first inner loop-shaped wall 22 and the first wind guide wall 23.

The first outer loop-shaped wall 21 cooperates with the first inner loop-shaped wall 22 and the first flow-splitting wall 24 to define a first loop-shaped space 25 in fluid communication with the wind supply opening 112 (see FIG. 2) and permitting entry of the airflow. The first loop-shaped space 25 is divided by the first flow-splitting wall 24 into a first main flow space portion 251 and a first branch flow space portion 252, and has a first air outlet 253 disposed between the distal end portions 211, 221 of the first outer and inner loop-shaped walls 21, 22, so as to permit exit of the airflow out of the first main flow space portion 251 therethrough.

The first wind guide wall 23 cooperates with the distal end portion 211 of the first outer loop-shaped wall 21 to define a first flow guide channel 231 therebetween. The first wind guide wall 23 has a plurality of first air inlets 232 that are angularly spaced apart from each other and that are disposed in proximity to a junction between the first wind guide wall 23 and the rear periphery 213 of the first outer loop-shaped wall 21. The first air inlets 232 are in fluid communication with the first flow guide channel 231. The first flow guide channel 231 has a first wind increasing opening 233 at an end thereof distal from the first air inlets 232, and is adjacent to and in fluid communication with the first air outlet 253.

The second wind guide device 3 is similar in construction to the first wind guide device 2, and also includes a second outer loop-shaped wall 31 disposed around a second axis 30 and having opposite front and rear peripheries 312, 313, a second inner loop-shaped wall 32 surrounded by the second outer loop-shaped wall 31 and extending inclinedly from the front periphery 312 toward the rear periphery 313, a second wind guide wall 33 surrounded by the second outer loop-shaped wall 31 and extending from the rear periphery 313 toward the second inner loop-shaped wall 32, and a second flow-splitting wall 34 extending from the second inner loop-shaped wall 32 in a direction away from the second axis 30 and connected between the second outer and inner loop-shaped walls 31, 32.

The second inner loop-shaped wall 32 has a distal end portion 321 adjacent to the rear periphery 313 of the second outer loop-shaped wall 31. The second outer loop-shaped wall 31 has a distal end portion 311 extending curvedly between the distal end portion 321 of the second inner loop-shaped wall 32 and the second wind guide wall 33. The second outer loop-shaped wall 31 cooperates with the second inner loop-shaped wall 32 and the second flow-splitting wall 34 to define a second loop-shaped space 35 therebetween. The second loop-shaped space 35 is divided by the second flow-splitting wall 34 into a second main flow space portion 351 and a second branch flow space portion 352, and has a second air outlet 353 disposed between the distal end portions 311, 321 of the second outer and inner loop-shaped walls 31, 32 and in fluid communication with the second main flow space portion 351. The second wind guide wall 33 cooperates with the distal end portion 311 of the second outer loop-shaped wall 31 to define a second flow guide channel 331. The second wind guide wall 33 has a plurality of second air inlets 332 angularly spaced apart from each other and disposed in proximity to a junction between the second wind guide wall 33 and the rear periphery 313 of the second outer loop-shaped wall 31. The second air inlets 332 are in fluid communication with the second flow guide channel 331. The second flow guide channel 331 has a second wind increasing opening 333 adjacent to and in fluid communication with the second air outlet 353.

Figure 6:
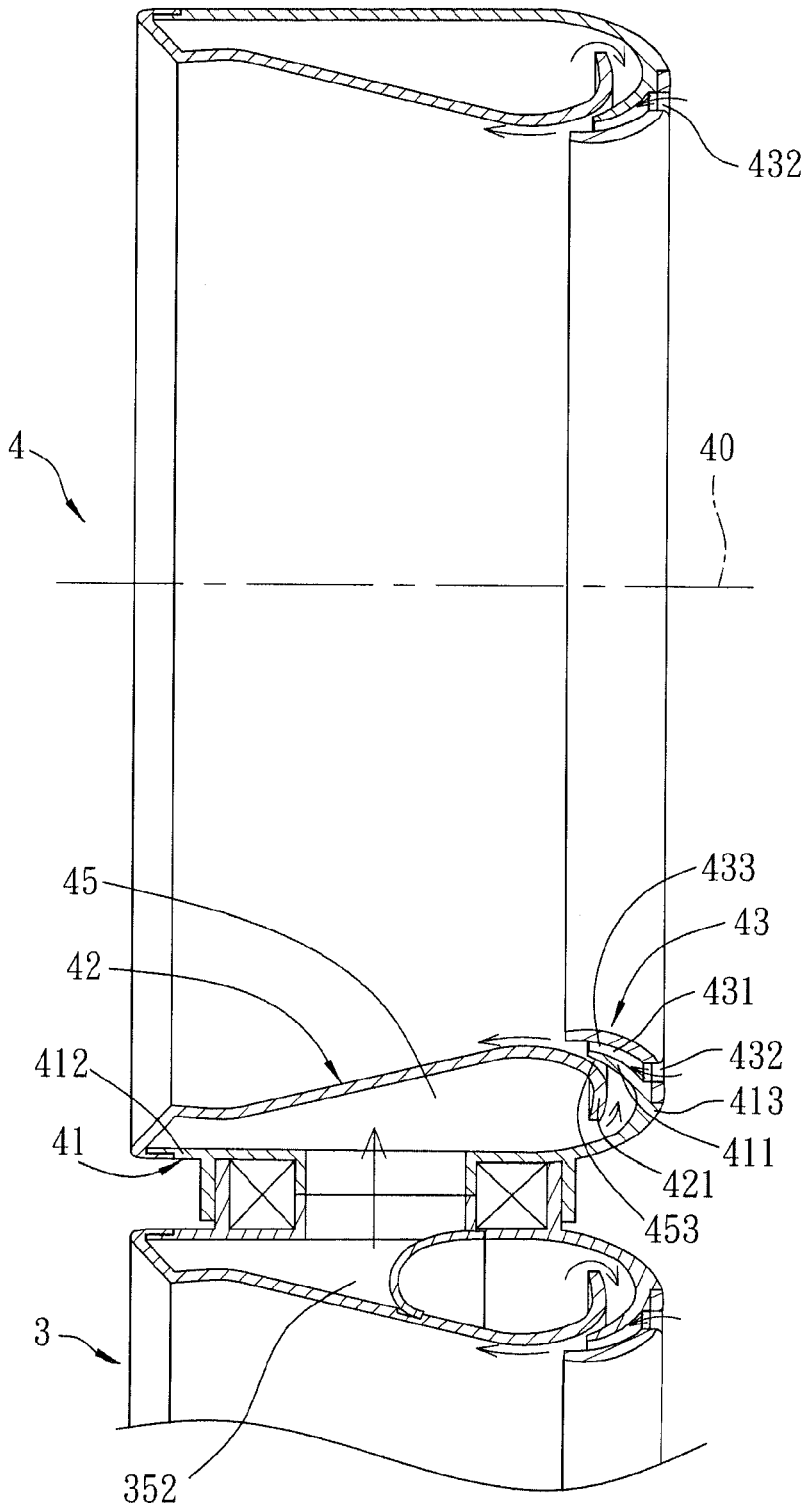
FIG. 6 is an enlarged view of another portion of FIG. 4, illustrating the second and third wind guide devices.

With further reference to FIG. 6, the third wind guide device 4 is similar in construction to the second wind guide device 3, and also includes a third outer loop-shaped wall 41 disposed around a third axis 40 and having opposite front and rear peripheries 412, 413, a third inner loop-shaped wall 42 surrounded by the third outer loop-shaped wall 41 and extending inclinedly from the front periphery 412 toward the rear periphery 413, and a third wind guide wall 43 surrounded by the third outer loop-shaped wall 41 and extending from the rear periphery 413 toward the third inner loop-shaped wall 42.

Unlike the second wind guide device 3, a top end of the third wind guide device 4 is not connected to any additional wind guide device, so that it is not necessary for the third wind guide device 4 to be provided with means for splitting the airflow entering the third wind guide device 4. For example, no flow-splitting wall is included in the third wind guide device 4.

The third inner loop-shaped wall 42 has a distal end portion 421 adjacent to the rear periphery 413 of the third outer loop-shaped wall 41. The third outer loop-shaped wall 41 has a distal end portion 411 extending curvedly between the distal end portion 421 of the third inner loop-shaped wall 42 and the third wind guide wall 43. The third outer and inner loop-shaped walls 41, 42 cooperate to define a third loop-shaped space 45 therebetween. The third loop-shaped space 45 has a third air outlet 453 disposed between the distal end portions 411, 421 of the third outer and inner loop-shaped walls 41, 42. The third wind guide wall 43 cooperates with the distal end portion 411 of the third outer loop-shaped wall 41 to define a third flow guide channel 431. The third wind guide wall 43 has a plurality of third air inlets 432 angularly spaced apart from each other and disposed in proximity to a junction between the third wind guide wall 43 and the rear periphery 413 of the third outer loop-shaped wall 41. The third air inlets 432 are in fluid communication with the third flow guide channel 431. The third flow guide channel 431 has a third wind increasing opening 433 adjacent to and in fluid communication with the third air outlet 453.

With particular to FIGS. 4, 5, and 6, during use, when the airflow created by the wind supply device 1 (see FIG. 1) enters the first loop-shaped space 25, it is divided into two portions so that the two portions flow respectively into the first main and branch flow space portions 251, 252. The air entering the first branch flow space portion 252 continues to flow into the second loop-shaped space 35, while the air entering the first main flow space portion 251 flows out of the first wind guide device 2 through a space between the distal end portion 211 of the first outer loop-shaped wall 21 and the first inner loop-shaped wall 22. When air flows forwardly from the first air outlet 253, according to Bernoulli Principle stating that pressure increases when speed reduces, surrounding air is drawn into the first flow guide channel 231 through the first air inlets 232, and is combined with the air flowing from the first air outlet 253 when flowing forwardly from the first wind increasing opening 233. As a result, the amount and speed of the airflow exiting the first wind guide device 2 are increased significantly.

Similarly, air flows from the first wind guide device 2 into the second main and branch flow space portions 351, 352 in the third wind guide device 3. Subsequently, the air entering the second branch space portion 352 continues to flow into the third loop-shaped space 45, and the air entering the second main space portion 351 flows forwardly out of the second air outlet 353, such that surrounding air is forced into the second air inlets 332 and flows through the second flow guide channel 331 to combine with the air flowing out of the second air outlet 353.

The air entering the third loop-shaped space 45 flows out of the third wind guide device 4 through the third air outlet 453. When air flows forwardly from the third air outlet 453, surrounding air is also forced to flow into the third wind guide device 4 to thereby combine with the air flowing forwardly out of the third air outlet 353.

If desired, any of the first, second, and third wind guide devices 2, 3, 4 can be rotated by 180° to provide a rearward airflow.

In this embodiment, the volume ratio of the first main flow space portion 251 to the first branch space portion 252 is 1:2, and the volume ratio of the second main flow space portion 351 to the second branch space portion 352 is 1:1. As such, one third of the air entering the first wind guide device 2 flows out of the first air outlet 253, and two thirds of the air entering the first wind guide device 2 flows into the second wind guide device 3. Thereafter, one half of the air entering the second wind guide device 3 flows out of the second air outlet 353, and the other half of the air entering the second wind guide device 3 flows into the third wind guide device 4 and out of the same through the third air outlet 453. Consequently, the amount of the airflow exiting the second wind guide device 3 is the same as that of the airflow exiting the third wind guide device 4. Alternatively, these volume ratios and the number of the wind guide devices 2, 3, 4 may be changed. If only the first wind guide device 2 is provided, the first flow-splitting wall 24 can be omitted. Or, if only the first and second wind guide devices 2, 3 are provided, the second flow-splitting wall 34 can be omitted. In addition, at least one wind guide device may be added.

In view of the above, the fan of this invention can provide airflow through the first, second, and third wind guide devices 2, 3, 4 in such a manner that, when the airflow exits the first, second, and third wind guide devices 2, 3, 4, surrounding air is drawn into the first, second, and third wind guide devices 2, 3, 4 to combine therewith, thereby increasing the amount and speed of the airflow exiting the fan. Thus, the object of this invention is achieved.

With this invention thus explained, it is apparent that numerous modifications and variations can be made without departing from the scope and spirit of this invention. It is therefore intended that this invention be limited only as indicated by the appended claims.

I claim:

1. A fan comprising:

a wind supply device including a hollow base, a blade disposed within the base, and a motor disposed within the base for rotating the blade to create an airflow, the base having a wind supply opening permitting the airflow to exit the base therethrough; and a first wind guide device disposed on the base of the wind supply device and including a first outer loop-shaped wall that is disposed around a first axis and that has opposite front and rear peripheries, a first inner loop-shaped wall surrounded by the first outer loop-shaped wall and secured to and extending from the front periphery of the first outer loop-shaped wall toward the rear periphery of the first outer loop-shaped wall, and a first wind guide wall secured to and extending from the rear periphery of the first outer loop-shaped wall toward the first inner loop-shaped wall, the first inner loop-shaped wall having a distal end portion adjacent to the rear periphery of the first outer loop-shaped wall and extending away from the first axis, the first outer loop-shaped wall further having a distal end portion extending from the rear periphery of the first outer loop-shaped wall and between the distal end portion of the first inner loop-shaped wall and the first wind guide wall, the first outer and inner loop-shaped walls cooperating to define a first loop-shaped space in fluid communication with the wind supply opening and permitting the airflow to enter thereinto, the first loop-shaped space having a first air outlet disposed between the distal end portions of the first outer and inner loop-shaped walls and permitting exit of the airflow therefrom, the first wind guide wall cooperating with the distal end portion of the first outer loop-shaped wall to define a first flow guide channel, the first wind guide wall having a front end disposed in front of the distal end portion of the first outer loop-shaped wall, and a plurality of first air inlets that are angularly spaced apart from each other, that are adjacent to the rear periphery of the first outer loop-shaped wall, and that are in fluid communication with the first flow guide channel, the first flow guide channel having a first wind increasing opening that is disposed at an end thereof distal from the first air inlets and that is in fluid communication with the first air outlet so that, when the airflow occurs in the first loop-shaped space, surrounding air is forced to enter the first flow guide channel through the first air inlets and exit the first flow guide channel through the first wind increasing opening to combine with the air flowing from the first air outlet.

2. The fan as claimed in claim 1, wherein the first wind guide device is disposed rotatably on and above the base of the wind supply device.

3. The fan as claimed in claim 1, wherein:

the first wind guide device further includes a first flow-splitting wall secured to and extending from the first inner loop-shaped wall in a direction away from the first axis and connected between the first outer and inner loop-shaped walls, so as to divide the first loop-shaped space into a first main flow space portion and a first branch flow space portion, the first air outlet being in fluid communication with the first main flow space portion; and the fan further comprises a second wind guide device disposed on and above the first wind guide device, the second wind guide device including a second outer loop-shaped wall that is disposed around a second axis and that has opposite front and rear peripheries, and a second inner loop-shaped wall surrounded by the second outer loop-shaped wall and secured to and extending from the front periphery of the second loop-shaped wall toward the rear periphery of the second outer loop-shaped wall, the second inner loop-shaped wall having a distal end portion adjacent to the rear periphery of the second outer loop-shaped wall and extending away from the second axis, the second outer loop-shaped wall further having a distal end portion extending from the rear periphery of the second outer loop-shaped wall toward the second axis and spaced apart from the distal end portion of the second inner loop-shaped wall, the second outer and inner loop-shaped walls cooperating to define a second loop-shaped space in fluid communication with the first branch flow space portion and permitting the airflow to enter thereinto, the second loop-shaped space having a second air outlet disposed between the distal end portions of the second outer and inner loop-shaped walls and permitting exit of the airflow out of the second loop-shaped space therethrough.

4. The fan as claimed in claim 3, wherein the second wind guide device further includes a second wind guide wall surrounded by the second outer loop-shaped wall and secured to and extending from the rear periphery of the second outer loop-shaped wall toward the second inner loop-shaped wall, the second wind guide wall being spaced apart from and adjacent to the distal end portion of the second outer loop-shaped wall and cooperating with the distal end portion of the second outer loop-shaped wall to define a second flow guide channel, the second wind guide wall having a front end disposed in front of the distal end portion of the second outer loop-shaped wall, and a plurality of second air inlets that are angularly spaced apart from each other, that are adjacent to the rear periphery of the second outer loop-shaped wall, and that are in fluid communication with the second flow guide channel, the second flow guide channel having a second wind increasing opening that is disposed at an end thereof distal from the second air inlets and that is in fluid communication with the second air outlet so that, when the airflow occurs in the second loop-shaped space, surrounding air is forced to enter the second flow guide channel through the second air inlets and exit the second flow guide channel through the second wind increasing opening to combine with the air flowing from the second loop-shaped space.

5. The fan as claimed in claim 4, wherein the first wind guide device is disposed rotatably on and above the base of the wind supply device, and the second wind guide device is disposed rotatably on and above the first wind guide device.

6. The fan as claimed in claim 3, wherein:

the second wind guide device further includes a second flow-splitting wall secured to and extending from the second inner loop-shaped wall in a direction away from the second axis and connected between the second outer and inner loop-shaped walls, so as to divide the second loop-shaped wall into a second main flow space portion and a second branch flow space portion, the second air outlet being in fluid communication with the second main flow space portion; and the fan further comprises a third wind guide device disposed on and above the second wind guide device, the third wind guide device including a third outer loop-shaped wall that is disposed around a third axis and that has opposite front and rear peripheries, and a third inner loop-shaped wall surrounded by the third outer loop-shaped wall and secured to and extending from the front periphery of the third outer loop-shaped wall toward the rear periphery of the third outer loop-shaped wall, the third inner loop-shaped wall having a distal end portion adjacent to the rear periphery of the third outer loop-shaped wall and extending away from the third axis, the third outer loop-shaped wall further having a distal end portion extending from the rearward periphery of the third outer loop-shaped wall toward the third axis and being spaced apart from the distal end portion of the third inner loop-shaped wall, the third outer and inner loop-shaped walls cooperating to define a third loop-shaped space in fluid communication with the second branch flow space portion and permitting the airflow to enter thereinto, the third loop-shaped space having a third air outlet disposed between the distal end portions of the third outer and inner loop-shaped walls and permitting exit of the airflow out of the third loop-shaped space therethrough.

7. The fan as claimed in claim 6, wherein the third wind guide device further includes a third wind guide wall surrounded by the third outer loop-shaped wall and secured to and extending from the rear periphery of the third outer loop-shaped wall toward the third inner loop-shaped wall, the third wind guide wall being spaced apart from and adjacent to the distal end portion of the third outer loop-shaped wall and cooperating with the distal end portion of the third outer loop-shaped wall to define a third flow guide channel, the third wind guide wall having a front end disposed in front of the distal end portion of the third outer loop-shaped wall, and a plurality of third air inlets that are angularly spaced apart from each other, that are adjacent to the rear periphery of the third outer loop-shaped wall, and that are in fluid communication with the third flow guide channel, the third flow guide channel having a third wind increasing opening that is disposed at an end thereof distal from the third air inlets and that is in fluid communication with the third air outlet so that, when the airflow occurs in the third loop-shaped space, surrounding air is forced to enter the third flow guide channel through the third air inlets and exit the third flow guide channel through the third wind increasing opening to combine with the air flowing from the third loop-shaped space.

8. The fan as claimed in claim 6, wherein the first wind guide device is disposed rotatably on and above the base of the wind supply device, the second wind guide device being disposed rotatably on and above the first wind guide device, the third wind guide device being disposed rotatably on and above the second wind guide device.

9. The fan as claimed in claim 6, wherein a volume ratio of the first main flow space portion to the first branch flow space portion is about 1:2, and a volume ratio of the second main flow space portion to the second branch flow space is about 1:1.

* * * * *